US010495417B1

(12) United States Patent
Geissele

(10) Patent No.: US 10,495,417 B1
(45) Date of Patent: Dec. 3, 2019

(54) SELF-CALIBRATING FIREARM ACCESSORY MOUNT

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/186,771

(22) Filed: Nov. 12, 2018

Related U.S. Application Data

(60) Provisional application No. 62/744,837, filed on Oct. 12, 2018.

(51) Int. Cl.
*F41G 1/387* (2006.01)
*F41G 11/00* (2006.01)

(52) U.S. Cl.
CPC ..... *F41G 11/003* (2013.01)

(58) Field of Classification Search
CPC . F41G 1/387; F41G 1/393; F41G 1/41; F41G 11/001; F41G 11/002; F41G 11/003; F41G 11/004
USPC ..... 42/124, 125, 126, 127, 128
See application file for complete search history.

(56) References Cited

U.S. PATENT DOCUMENTS 3,414,221 A * 12/1968 Nelson ..... F41G 11/001 248/316.5
5,666,757 A * 9/1997 Helmstadter ..... F41A 23/04 42/94
6,931,778 B1 * 8/2005 Nelson ..... F41G 1/35 42/120
10,048,040 B1 * 8/2018 Ratliff ..... F41G 11/003
2010/0107467 A1 * 5/2010 Samson ..... F41G 11/003 42/127
2011/0146128 A1 * 6/2011 Haering ..... F41G 11/003 42/90
2013/0000176 A1 * 1/2013 Goertzen ..... F41G 11/001 42/90

* cited by examiner

*Primary Examiner* — Bret Hayes
(74) *Attorney, Agent, or Firm* — Fox Rothschild LLP

(57) ABSTRACT

The disclosure relates to a firearm accessory mount having a fastening system that is self-calibrated to achieve a proper predetermined attachment force for securely attaching the accessory mount to a firearm, without the need for a torque wrench.

22 Claims, 7 Drawing Sheets

SELF-CALIBRATING FIREARM ACCESSORY MOUNT

CROSS-REFERENCE TO RELATED APPLICATION

This application claims the benefit of priority to U.S. Provisional Patent Application No. 62/744,837 filed Oct. 12, 2018, the disclosure of which is hereby incorporated by reference in its entirety.

BACKGROUND

Various accessories, such as scopes, rangefinders, infrared lasers, and other sighting instruments, may be mounted to a firearm via an accessory mount. Conventional mounts are typically secured to a firearm by clamping the mount to a firearm rail using a simple nut and bolt assembly. However, in order to adequately secure the mount with the requisite attachment force using such a simple assembly, a user must torque the nut with a torque wrench, thereby requiring the user to have a torque wrench available any time the accessory mount is installed or adjusted on the rail.

Thus, there is a need to facilitate the attachment of an accessory mount to a firearm.

SUMMARY

The present disclosure relates generally to a firearm accessory mount, and more particularly, to a firearm accessory mount having a fastening system that is self-calibrated to achieve the proper attachment force.

In one aspect, the disclosed technology relates to an accessory mount for attaching an accessory to a firearm including: at least one cross-bolt assembly configured to attach the accessory mount to the firearm, wherein the at least one cross-bolt assembly extends perpendicular to a longitudinal direction of the accessory mount and includes: a housing; a biasing assembly configured to fit within the housing and to provide an axial attachment force; and an extension feature configured to be inserted through the biasing assembly and the housing and to be fastened to the accessory mount.

In one embodiment, an opening of the housing is configured to receive a head of the extension feature, and the head of the extension feature is configured to prevent the extension feature from rotating in a circumferential direction as the extension feature is fastened to the accessory mount. In another embodiment, the head of the extension feature is configured to fit within the opening of the housing. In another embodiment, the biasing assembly is further configured to provide an axial attachment force of about 750 pounds to about 1000 pounds. In another embodiment, the housing includes a stop shelf formed on one or more inner surfaces of the housing. In another embodiment, the stop shelf is configured to prevent a head of the extension feature from moving inwardly beyond a portion of the housing. In another embodiment, the biasing assembly includes at least one Belleville washer. In another embodiment, the biasing assembly includes at least one flat washer and a plurality of Belleville washers. In another embodiment, the extension feature includes a groove locator configured to fit between two consecutive ribs of a mounting platform of the firearm. In another embodiment, the extension feature is fastened to the accessory mount by a fastener, and wherein the extension feature includes a distorted end configured to prevent the fastener from detaching from the extension feature. In another embodiment, at least one mounting cap is removably securable to an upper portion of the accessory mount, the at least one mounting cap configured to form a passage extending in a longitudinal direction of the accessory mount. In another embodiment, the accessory mount further includes an indicator rotatably connected to the accessory mount, wherein the indicator is configured to indicate a predetermined attachment force when rotated to an upper position. In another embodiment, the extension feature is a bolt.

In another aspect, the disclosed technology relates to a method of attaching an accessory mount to a firearm with a predetermined attachment force, including the steps of obtaining an accessory mount including at least one cross-bolt assembly configured to attach the accessory mount to the firearm, wherein the at least one cross-bolt assembly extends perpendicular to a longitudinal direction of the accessory mount and includes: a housing having a first attachment feature, a biasing assembly configured to fit within the housing and to provide the predetermined attachment force, and an extension feature configured to be inserted through the biasing assembly, the housing, and a second attachment feature positioned on a side of the accessory mount opposite the first attachment feature, and to be fastened to the accessory mount by a fastener; positioning the accessory mount on a rail of the firearm; and tightening the fastener onto the extension feature, thereby fastening the accessory mount to the firearm via the first and second attachment features, wherein the accessory mount is attached to the firearm with the predetermined attachment force without using a torque wrench.

In one embodiment, the housing includes a stop shelf formed on one or more inner surfaces of the housing, and wherein tightening the fastener on the extension feature further includes tightening the fastener until the extension feature contacts the stop shelf. In another embodiment, when the extension feature contacts the stop shelf, the accessory mount is fastened to the firearm with a predetermined attachment force of about 750 pounds to about 1000 pounds. In another embodiment, an opening of the housing is configured to receive a head of the extension feature, and wherein the head of the extension feature is configured to prevent the extension feature from rotating in a circumferential direction as the extension feature is fastened to the accessory mount. In another embodiment, the biasing assembly includes at least one flat washer and a plurality of Belleville washers. In another embodiment, the accessory mount further includes an indicator rotatably connected to the accessory mount, and wherein tightening the fastener on the extension feature rotates the indicator in an upward direction, and thereby indicates an increasing amount of attachment force. In another embodiment, the extension feature is a bolt.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE FIGURES

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
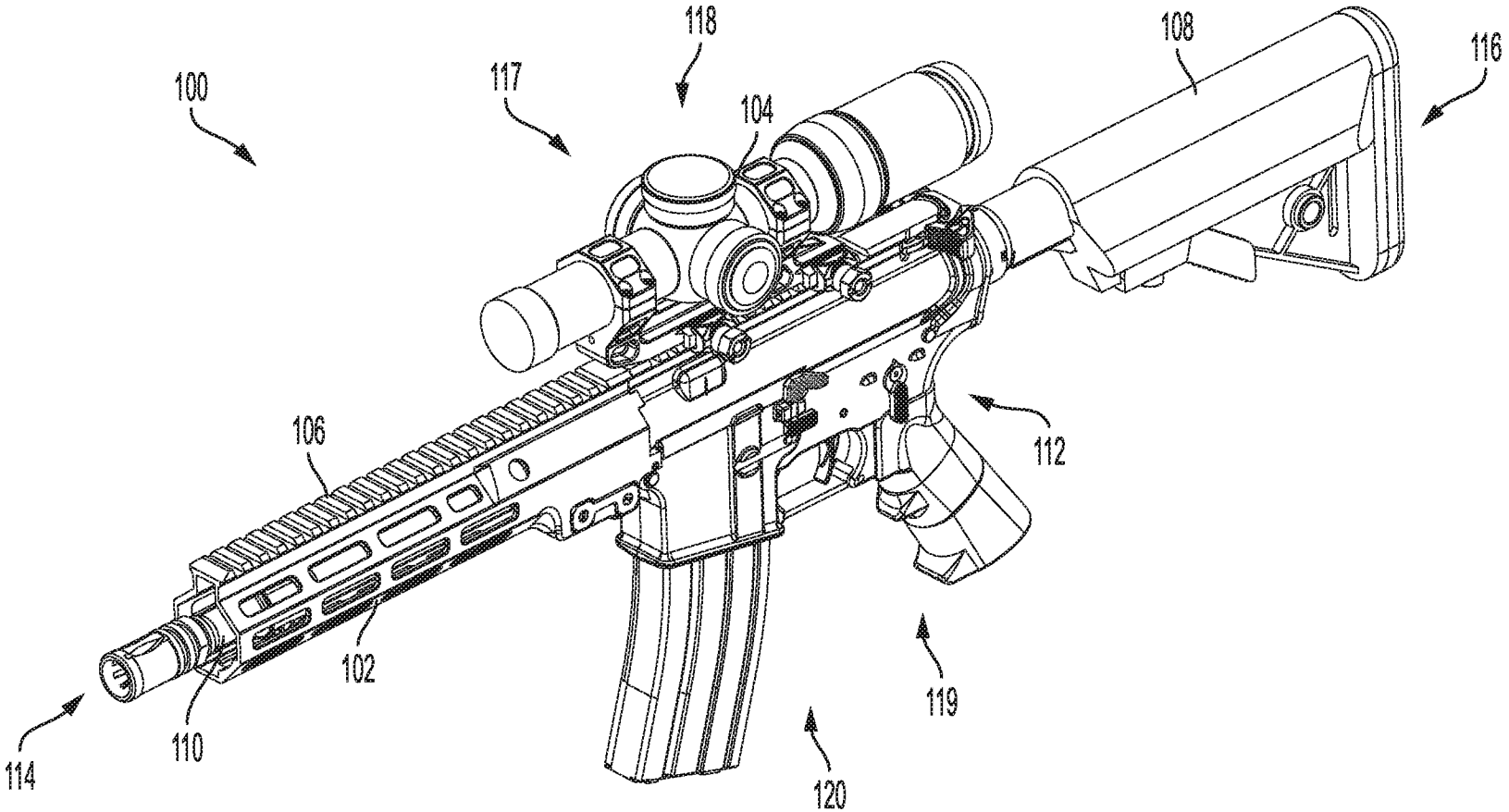
FIG. 1 illustrates a perspective view of an example firearm including an example accessory mount.

The following discussion omits or only briefly describes conventional features of firearms and firearm mechanisms that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof.

Embodiments of the present disclosure relate generally to a firearm accessory mount, and more particularly, to a firearm accessory mount having a fastening system that is self-calibrated to achieve the proper attachment (clamping) force. Embodiments of the firearm accessory mount are described below with reference to FIGS. 1-5B.

FIG. 1 illustrates a perspective view of an example firearm 100 including an example accessory mount 104, according to some embodiments of the present disclosure.

In one or more embodiments, the firearm 100 includes at least one of a handguard 102, a stock 108, a barrel 110, and a receiver 112. The firearm 100 is defined by a front 114, a back 116, a right side 117, a top 118, a left side 119, and a bottom 120. Throughout this disclosure, references to orientation (e.g., front, frontward, rear, rearward, in front, behind, above, below, high, low, back, top, bottom, under, underside, right side, left side, etc.) of structural components shall be defined by that component's positioning in FIG. 1 relative to, as applicable, the front 114, the back 116, the right side 117, the top 118, the left side 119, and the bottom 120 of the firearm 100, regardless of how the firearm 100 may be held and regardless of how that component (e.g., the accessory mount 104) may be situated on its own (i.e., separated from the firearm 100). The barrel 110 is positioned at a forward end of the firearm 100 and is configured to be installed on the receiver 112. The handguard 102 surrounds the barrel 110 and is attached to the receiver 112.

In one or more embodiments, a mounting platform 106 extends from the handguard 102 to the receiver 112. In other embodiments, the mounting platform 106 is disposed only on either the handguard 102 or the receiver 112. In some embodiments, the mounting platform 106 is disposed on one or more sides of the handguard 102, for example a top side of the handguard 102. In one or more embodiments, the mounting platform 106 is configured to facilitate mounting accessories (e.g., a fore-grip, a flashlight, a laser, optic equipment, scopes, rangefinders, infrared lasers, other sighting instruments, etc.) to the firearm 100. For example, a scope may be mounted to the firearm 100, via the firearm accessory mount 104 that is fastened to the mounting platform 106. In some embodiments, the mounting platform 106 can be an integral part of the handguard 102. In other embodiments, the mounting platform 106 can be modular, i.e., attachable to and removable from the handguard 102 with fasteners (e.g., screws, bolts, pins, etc.) that mate with fastener receivers integrated with the handguard 102.

In some embodiments, the mounting platform 106 includes mounting ribs 105, which may alternate with a groove 107 between each mounting rib 105. The mounting ribs 105, with their corresponding grooves 107, provide an engagement surface for mounting the accessory mount 104. In one or more embodiments, the accessory mount 104 has one or more mount protrusions 150*a* and 150*b* and one or more groove locators 146*a* and 146*b* that fittedly engage the grooves 107 and mounting ribs 105. In an example, the mounting platform 106, including the ribs 105 and grooves 107, may use a standard dimension and platform, such as a Picatinny style mounting platform, also known as a Picatinny rail and/or a MIL-STD-1913. It is noted that the Picatinny style mounting platform is an illustrative example, and the mounting platform 106 may have dimensions and styles of other types of mounting platforms, for example, a Weaver rail, an ergonomic modular rail, or another suitable type of rail known in the art.

Figure 2A:
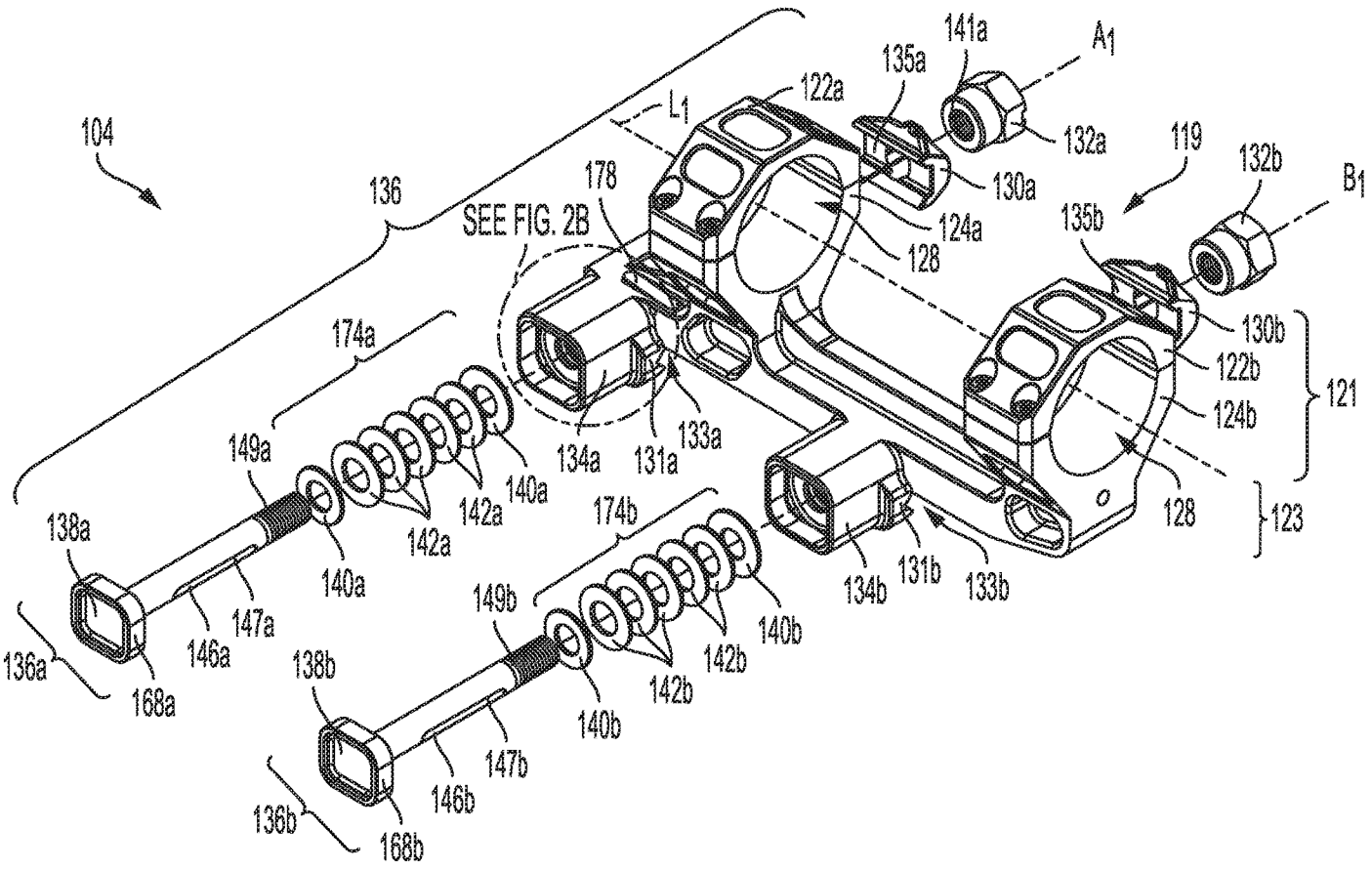
FIG. 2A illustrates an exploded perspective view of the example accessory mount.
Figure 2B:
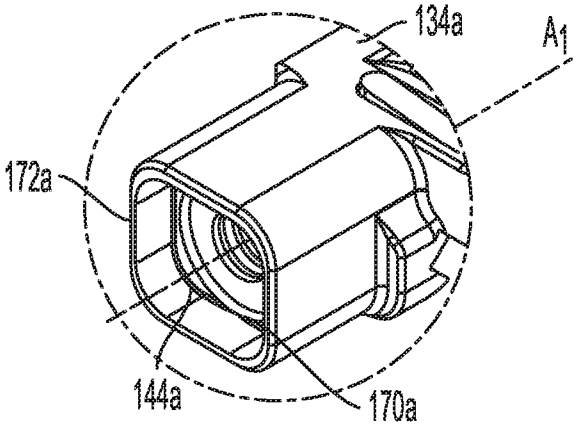
FIG. 2B illustrates an enlarged view of a housing of the example accessory mount.

FIG. 2A illustrates an exploded perspective view of the accessory mount 104, according to one or more embodiments of the present disclosure. FIG. 2B illustrates an enlarged view of a housing 134*a* of the accessory mount 104, according to one or more embodiments of the present disclosure.

In one or more embodiments, the accessory mount 104 includes an upper portion 121 and a lower portion 123. In some embodiments, the upper portion 121 and the lower portion 123 are machined together to form a unitary body. In other embodiments, the upper portion 121 and the lower portion 123 are two individual bodies configured to be fastened to one another.

In one or more embodiments, the upper portion 121 includes a pair of first and second mounting posts 124*a* and 124*b*, respectively, that are each configured to receive a first mounting cap 122*a* and a second mounting cap 122*b*, respectively. In one or more embodiments, mounting posts 124*a* and 124*b* are substantially identical. In other embodiments, mounting posts 124*a* and 124*b* differ in design. In one or more embodiments, a passage 128 is formed when the mounting posts 124*a* and 124*b* are secured to their respective mounting caps 122*a* and 122*b*. The passage 128 defines a space in which an accessory may be mounted within the passage 128. For example, when the first mounting cap 122*a* and the second mounting cap 122*b* are detached from the upper portion 121, a user may place an accessory, such as a scope, within the bottom half of the passage 128, that is, in the concave portions of the mounting posts 124*a* and 124*b*. Subsequently, the user may secure the accessory to the firearm 100 by fastening the first mounting cap 122*a* and second mounting cap 122*b* to the respective mounting posts 124*a* and 124*b*. In one or more embodiments, the passage 128 has a generally cylindrical shape defining an area for an accessory to be secured within the mount and ultimately to the firearm 100. In other embodiments, the first and second mounting caps 122*a* and 122*b* may be secured to the mounting posts 124*a* and 124*b* and thereby form other shaped passages defining an area for other differently shaped accessories to be secured within the mount and ultimately to the firearm 100. In one or more embodiments, the passage 128 extends in a longitudinal direction L1 with respect to the accessory mount 104.

In one or more embodiments, the lower portion 123 includes one or more biased (e.g., spring loaded) cross-bolt assemblies 136, such as cross-bolt assembly 136*a* and cross-bolt assembly 136*b*, configured to fasten the accessory mount 104 to the mounting platform 106.

For purposes of convenience and avoiding redundancy, the embodiments below discuss the features of cross-bolt assembly 136*a*; however, the embodiments are equally applicable to the features of cross-bolt assembly 136*b*, unless otherwise noted below. For example, bolt 138*a* has the same features as bolt 138*b*. Thus, it should be understood that structures identified by reference numbers of the cross-bolt assembly 136*b* having a "b" label have the same features as the corresponding structures identified by reference numbers of the cross-bolt assembly 136*a* having an "a" label.

In one or more embodiments, the cross-bolt assembly 136*a* includes an extension feature (referred to herein by non-limiting example as a bolt) 138*a* inserted into an arrangement of washers. Other suitable types of extension features include but are not limited to studs, rods, or other structures that serve the same purpose described herein. In one embodiment, the cross-bolt assembly 136*a* includes one or more flat washers 140*a* and/or one or more Belleville washers 142*a*. As used herein, a "Belleville washer" refers to any washer having a frusto-conical shape which provides the washer with characteristics of a spring—e.g., the term "Belleville washer" includes but is not limited to wave washers and die springs. As used herein, a "flat washer" refers to a washer having a substantially flat surface, including a hardened washer that does not have the characteristics of a spring. In some embodiments, the washers (Belleville and/or flat) may have an outer diameter of about 0.48 inches to about 0.6 inches. In some embodiments, the washers (Belleville and/or flat) may have a thickness of about 0.025 inches to about 0.4 inches.

One or more flat washer 140*a* may be configured to be positioned on the underside of the bolt 138*a* and/or on the surface of the pocket 170. The bolt 138*a* together with an arrangement of washers is inserted into a housing 134*a*. The bolt 138*a* extends in a transverse direction A1 across the accessory mount 104 to a side opposite the housing 134*a*. On the opposite side of the housing 134*a* (e.g., on the left side 119 of the housing 134*a*), the bolt 138*a* is inserted through another attachment feature (referred to herein by non-limiting example as a clamp) 130*a*. A fastener 132*a* (e.g., a nut) is attached to an end portion of the bolt 138*a* that extends beyond the clamp 130*a*. In one or more embodiments, the end portion of the bolt 138*a*, configured to receive the fastener 132*a*, includes a threaded portion 149*a*, and the fastener includes a complimentary threaded portion 141*a*. The threaded portion of the bolt 138*a* may be an internal thread or an external thread configured to receive the corresponding threads of the threaded portion 141*a* of the fastener 132*a*. In some embodiments, after the fastener 132*a* is attached to the bolt 138*a*, the end of the bolt 138*a* is distorted to form a distorted end (not shown), such that the fastener 132*a* is permanently fixed and cannot be detached from the bolt 138*a*—i.e., the cross-bolt assembly 136*a* cannot be disassembled, as the distorted end prevents the bolt from being unthreaded from the fastener. In other embodiments, the end of the bolt 138*a* is not distorted, but rather maintains a threaded end 149*a*, such that the fastener 132*a* can be detached (unthreaded) from the bolt 138*a* to disassemble the cross-bolt assembly 136*a*.

In one or more embodiments, the biased cross-bolt assembly 136*a* includes an attachment feature (referred to herein by non-limiting example as a clamp) 131*a* located on a bottom portion of the housing 134*a*. A mounting platform receiving portion 133*a* of the clamp 131*a* is configured to fit and interlock with a side portion of the mounting platform 106. Additionally, a mounting platform receiving portion 135*a* of the clamp 130*a* is configured to fit and interlock with an opposite side portion of the mounting platform 106. In one or more embodiments, when the accessory mount 104 is positioned on the mounting platform 106, clamp 130*a* and clamp 131*a* move toward one another along the bolt 138*a* as the fastener 132*a* is tightened onto the bolt 138*a*. By tightening the fastener 132*a*, the accessory mount 104 is fastened and secured to mounting platform of the firearm 100.

Figure 3A:
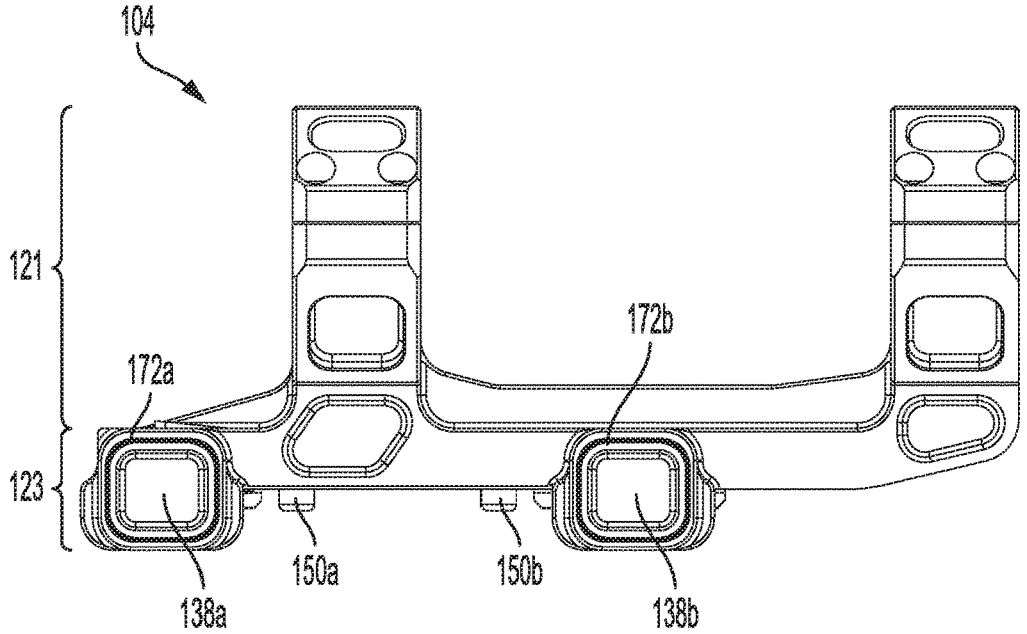
FIG. 3A illustrates a side view of the example accessory mount.
Figure 3B:
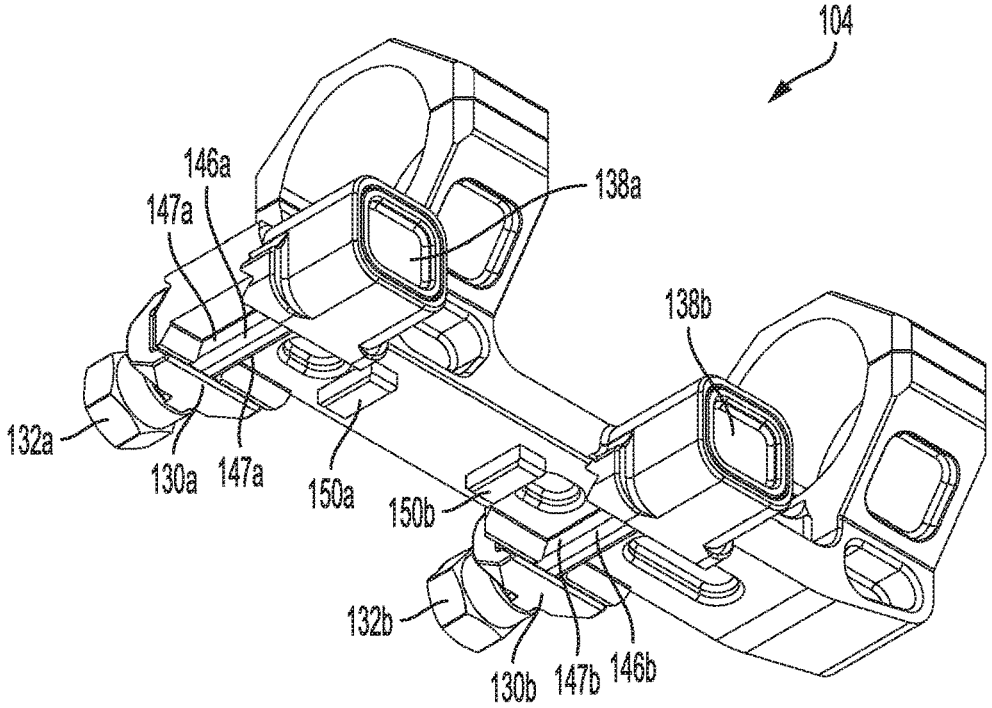
FIG. 3B illustrates a perspective view of the example accessory mount.

FIG. 3A illustrates a side view of the accessory mount 104, according to one or more embodiments of the present disclosure. FIG. 3B illustrates a perspective view of the accessory mount 104, according to one or more embodiments of the present disclosure. In one or more embodiments, the bolt 138*a* includes a groove locator 146*a*. The groove locator 146*a* is configured to fit between two consecutive mounting ribs 105 and a least partially in a groove 107 of the mounting platform 106. In some embodiments, the groove locator 146*a* extends in a lengthwise, longitudinal direction A1 with respect to the bolt 138*a*. Recesses 147*a* are formed on right and left sides of the bolt 138*a*, when viewed in the lengthwise, longitudinal direction A1 with respect to the bolt 138*a*. In some embodiments, the recesses 147*a* extend into the bolt 138*a* far enough, such that the bolt 138*a* can be positioned between the two mounting ribs 105. For example, a depth of the recesses 147*a* may correspond to the approximate depth of a mounting rib on a Picatinny rail, extending from approximately the bottom of the groove of the Picatinny rail to approximately the top surface of the mounting rib. In other embodiments, the recesses 147*a* extend across the diameter of the bolt 138*a*, such that the groove locator 146*a* extends from one portion of the outer surface of the bolt 138*a* to another portion of the outer surface of the bolt 138*a*.

In one or more embodiments, the bolt 138*a* includes a bolt head 168*a* configured to fit within an outermost portion of the housing 134*a*. The bolt head 168*a* and the wall 172*a* of the housing 134*a* are configured to interlock with one another, such that the bolt 138*a* cannot rotate while the fastener 132*a* is being tightened. For example, the bolt head 168*a* and wall 172*a* of the housing 134*a* may each have a square shape, in which the square shaped bolt head 168*a* fits within the square shaped wall 172*a* of the housing 134*a*. As the fastener 132*a* is tightened, the corners of the square shaped bolt head 168*a* interlock with the corners of the square shaped wall 172*a*, thereby preventing the bolt 136*a* from rotating.

In one or more embodiments, the bolt head 168*a* may be any one of a variety of non-rounded shapes, in which the wall 172*a* has a corresponding shape to interlock with the bolt head 168*a* and prevent the bolt 136*a* from rotating while the fastener 132*a* is being tightened. For example, the bolt head 168*a* may have a oval head and the wall 172*a* may be in a oval shape configured to receive the oval head; the bolt head 168*a* may have a triangular head and the wall 172*a* may also be in a triangular shape configured to receive the triangular head; or the bolt head 168*a* may have another non-circular or non-rounded shape bolt head and the wall 172*a* may have a corresponding non-circular or non-rounded shape configured to receive the non-circular or non-rounded shape bolt head.

In other embodiments, the bolt head 168*a* may have a rounded shape with a protrusion or indent for similarly interlocking with a corresponding indent or protrusion on the housing 134*a*. For example, the bolt head 168*a* may have a generally rounded shape and a portion of the bolt head 168*a* may protrude beyond the rounded portion of the bolt head 168*a*. The protruded portion of the bolt head 168*a* may be configured to fit within a notch formed in the wall 172*a* of the housing 134*a*. In some embodiments, the protruded portion of the bolt head 168*a* may be machined into and integral with the bolt head 168*a*. Alternatively, the protruded portion of the bolt head 168*a* may be a structural component, such as a pin, that is secured in the bolt head 168*a*. In another example, the bolt head 168*a* may have a generally rounded shape with a notch in the rounded portion of the bolt head 168*a*; and the wall 172*a* of the housing 134*a* may include a protrusion configured to fit within the notch in the rounded portion of the bolt head 168*a*. The protrusion on the wall 172*a* may be machined into and integral with the housing 134*a*. Alternatively, the protrusion on the wall 172*a* may also be a structural component, such as a pin, that is secured into the housing 134*a*.

In one or more embodiments, the accessory mount 104 includes one or more mount protrusions, such as mount protrusion 150*a*. The mount protrusion 150*a* may be located on a bottom surface of the accessory mount 104. The mount protrusion 150*a* may be configured to fit between two mounting ribs 105 and at least partially in a groove 107 of the mounting platform 106. In some embodiments, the mount protrusion 150*a* protrudes outwards from the bottom surface of the accessory mount 104 far enough to contact a portion of the sidewall of a mounting rib 105. In other embodiments, the mount protrusion 150*a* protrudes outwards from the bottom surface of the accessory mount 104 far enough to contact a surface (e.g., an inside surface) of the groove 107. In one or more embodiments, the mount protrusion 150*a* is machined into the accessory mount 104. The mount protrusion 150*a* may be machined into any one of a variety of shapes, for example, a square cube shape or a rectangular cube shape. In other embodiments, the mount protrusion 150*a* can be a cylindrical pin that is press fit or welded to the accessory mount 104. In one or more embodiments, the mount protrusion 150*a* is centered in the width direction of the accessory mount 104. In one or more embodiments, the mount protrusion 150*a* extends in the width direction across a portion of the accessory mount 104. In other embodiments, the mount protrusion 150*a* extends across the entire width of the accessory mount 104.

Figure 4A:
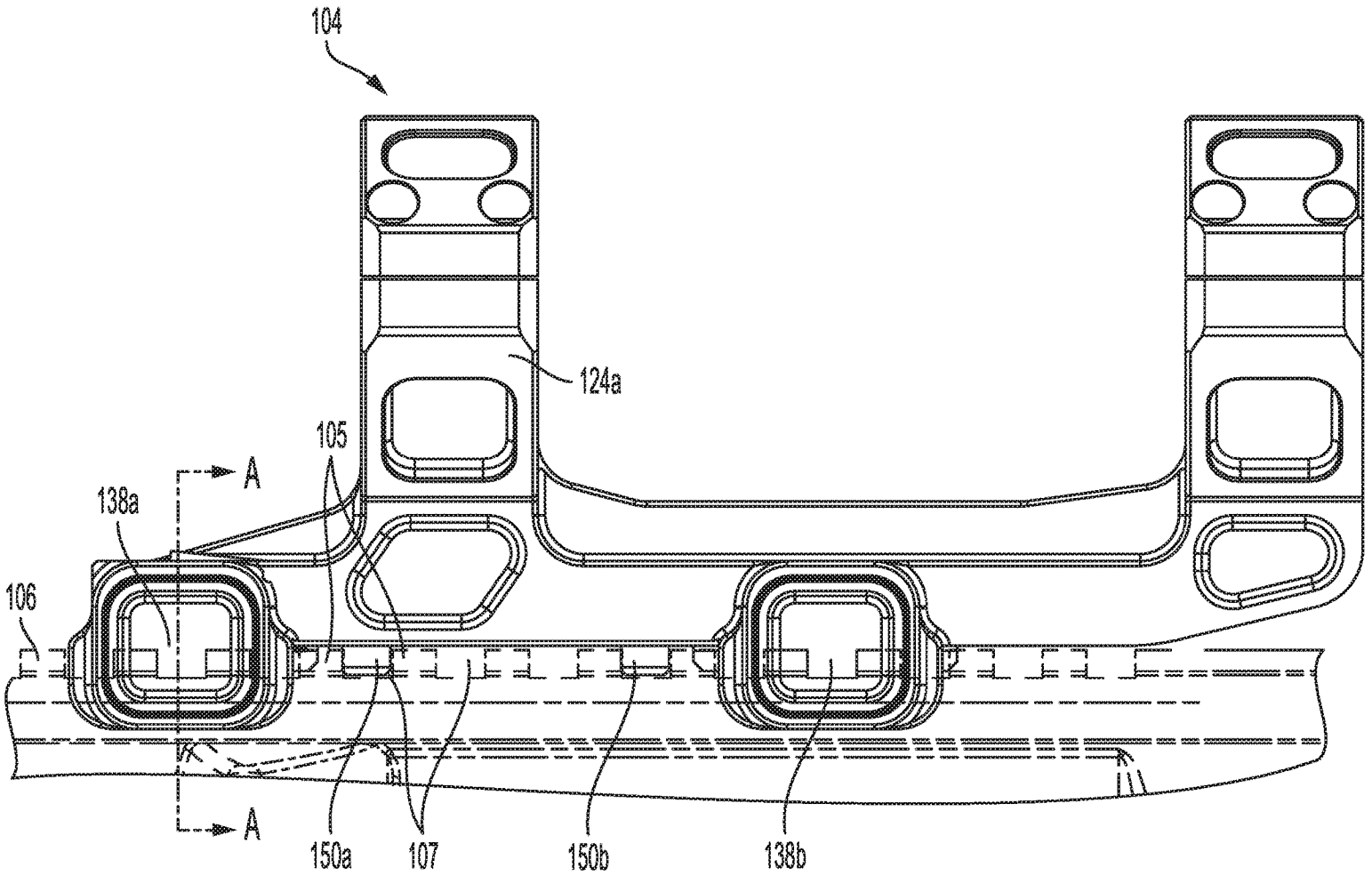
FIG. 4A illustrates a side view of the example accessory mount positioned on a portion of a mounting platform of a firearm.
Figure 4B:
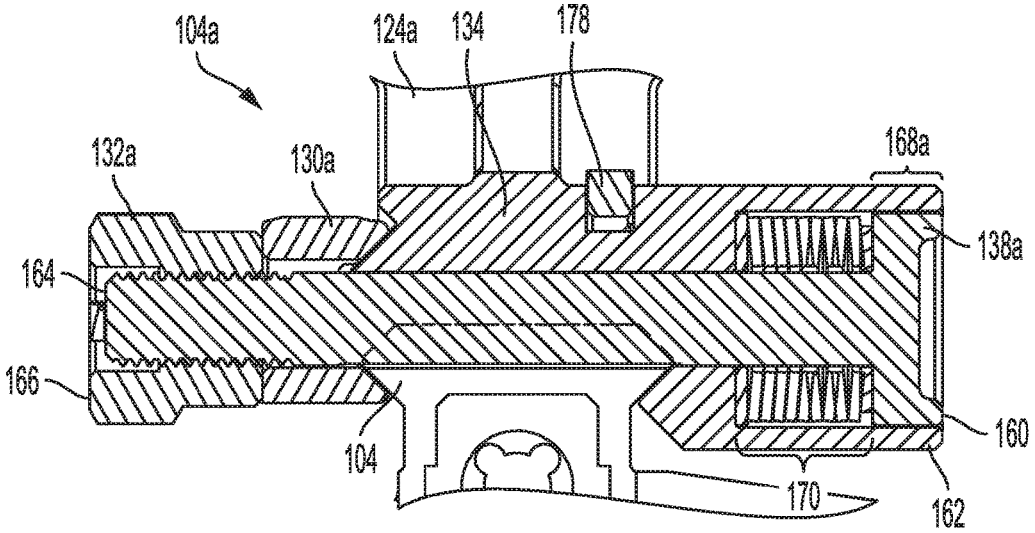
FIG. 4B illustrates a cross-sectional view of the example accessory mount in a tightened position on the firearm.
Figure 4C:
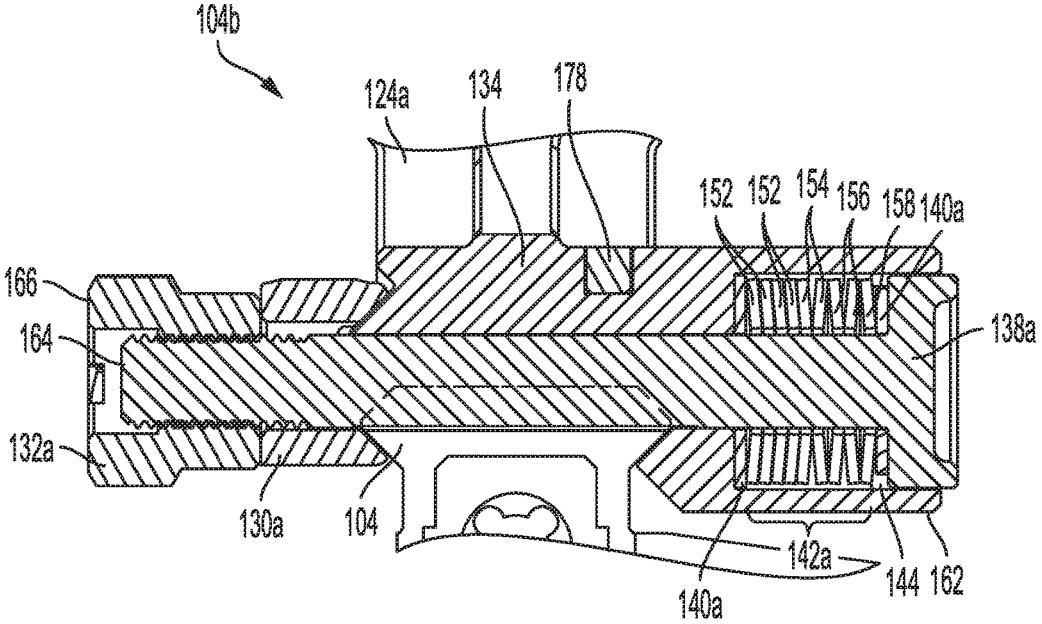
FIG. 4C illustrates a cross-sectional view of the example accessory mount in a loosened position on the firearm.

FIG. 4A illustrates a side view of the accessory mount 104 positioned on a portion of the mounting platform 106 of the firearm 100, according to one or more embodiments of the present disclosure. FIG. 4B illustrates a cross-sectional view of the accessory mount 104 in a tightened position on the firearm 100, according to one or more embodiments of the present disclosure. FIG. 4C illustrates a cross-sectional view of the accessory mount 104 in a loosened position on the firearm 100, according to one or more embodiments of the present disclosure.

To fasten the accessory mount 104 to the mounting platform 106, a user tightens the fastener 132*a*. As the accessory mount 104 is positioned on the mounting platform 106, the user may tighten the fastener 132*a* by hand and/or by using a conventional tool such as a wrench, including various types of wrenches known in the art, or pliers, including various types of pliers known in the art. A torque wrench is not needed and the fastener 132*a* may be advantageously tightened to the appropriate degree without the use of a torque wrench.

As the fastener 132*a* is tightened, a portion of the bolt 138*a* moves across the mounting platform 106 towards the fastener 132*a*, and the bolt head 168*a* compresses the biasing assembly 174*a*, arranged in the pocket 170*a*. In some embodiments, the fastener 132*a* can be tightened until the inner surface of the bolt head 168*a* contacts the bolt stop shelf 144*a*. In one or more embodiments, the bolt stop shelf 144*a* is configured to prevent the bolt head 168*a* from moving inwardly beyond a portion of the housing 134*a*.

The bolt stop shelf 144*a* may be an inner ridge within the housing 134*a* that protrudes from the inner surfaces of the wall 172*a* of the housing 134*a*. In some embodiments, the bolt stop shelf 144*a* is formed as one continuous ridge around each inner surface of the wall 172*a* of the housing 134*a*. In other embodiments, the bolt stop shelf 144*a* is formed on one or more inner surfaces of the wall 172*a* of the housing 134*a*. In one or more embodiments, when the inner surface of the bolt head 168*a* contacts the bolt stop shelf 144*a*, the fastener 132*a* is tightened such that the clamps 130*a* and 131*a* have a required amount of attachment force to secure the accessory mount 104 to the firearm 100, thereby a torque wrench is not necessary to tighten the fastener 132*a* to achieve the proper amount of attachment force.

The attachment force may include, for example, an axial attachment force. In one or more embodiments, the attachment force can be a predetermined attachment force, such as an attachment force of about 750 lbs to about 1000 pounds. In one or more embodiments, as shown in FIG. 4B, in a fastened state, an outer surface 160 of the bolt head 168*a* is aligned with an outer surface 162 of the housing. When the outer surface 160 of the bolt head 168*a* aligns with the outer surface 162 of the housing 134*a*, a user may accurately conclude that the fastener 132*a* is sufficiently tightened and that the clamps 130*a* and 131*a* have the required amount of axial attachment force to fully secure the accessory mount 104 to the firearm 100. In some embodiments, in the fastened position, the outer surface 164 of the threaded end 149*a* extends beyond the outer surface 166 of the fastener 132*a*.

To unfasten the accessory mount 104 from the mounting platform 106, a user loosens the fastener 132*a*. As the fastener 132*a* is loosened, a portion of the bolt 138*a* moves across the mounting platform 106 away from the fastener 132*a*. In some embodiments, the biasing assembly 174*a* decompresses as the portion of the bolt 138*a* moves away from the fastener 132*a* and the bolt head 168*a* moves out of the housing 134*a*. In a loosened state, the outer surface 160 of the bolt head 168*a* protrudes outwards farther than the outer surface 162 of the housing 134*a*. In some embodiments, in the unfastened position, the outer surface 164 of the threaded end 149*a* is located within the fastener 132*a*.

In one or more embodiments, the biasing assembly 174*a* is configured to compress and decompress within the pocket 170 of the housing 134*a*. For example, the biasing assembly may comprise one or more springs, a series of springs, one or more Belleville washers, a series of Belleville washers, one or more flat washers, a series of flat washers, any combination thereof, or another suitable biasing mechanism that serves the same purpose described herein. In some embodiments, the biasing assembly includes 1-10 springs and/or 1-10 Belleville washers, optionally in combination with 1-10 flat washers—e.g., 1, 2, 3, 4, 5, 6, 7, 8, 9, or 10 of any of the foregoing. In some embodiments, the biasing assembly 174*a* includes an arrangement of washers. For example, the biasing assembly 174*a* may include two flat washers 140*a* being arranged on the ends of the biasing assembly 174*a*, with a stack or series of Belleville washers 142*a* arranged between the two flat washers 140*a*. In another example, the biasing assembly 174*a* may include alternating flat washers 140*a* and Belleville washers 142*a*. In one or more embodiments, the Belleville washers 142*b* and flat washers 140*a* may be arranged to generate an axial attachment force of about 750 lbs to 1000 lbs. One arrangement of the biasing assembly 174*a* may include a parallel arrangement 152 of four Belleville washers 142*a* arranged on a flat washer 140*a*; a first series 154 of Belleville washers 142*a* arranged on the parallel arrangement 152 of four Belleville washers 142*a*; a second series 156 of Belleville washers 142*a* arranged on the first series 154 of Belleville washers 142*a*; a single disk 158 arranged on the second series 156 of Belleville washers 142*a*; and a flat washer arranged on the single disk 158. It should be noted that other arrangements or stacks of the biasing assembly 174*a* may be formed using a combination of flat washers 140*a* and Belleville washers 142*a*, having parallel and series arrangements. The arrangement or stack may be modified to change the spring constant and increase or decrease the desired or predetermined axial attachment force.

In some embodiments, the Belleville washers 142*a* and the flat washers 140*a* are formed of a hardened steel or alloy. For example, one or more flat washers may be formed from a material including carbon steel (e.g., 1095 steel) or an alloy thereof, and one or more Belleville washers may be formed from a material including carbon steel (e.g., 1070 or 1078 carbon steel), stainless steel (e.g., 17-7 or 18-8 stainless steel), or an alloy thereof.

Figure 5A:
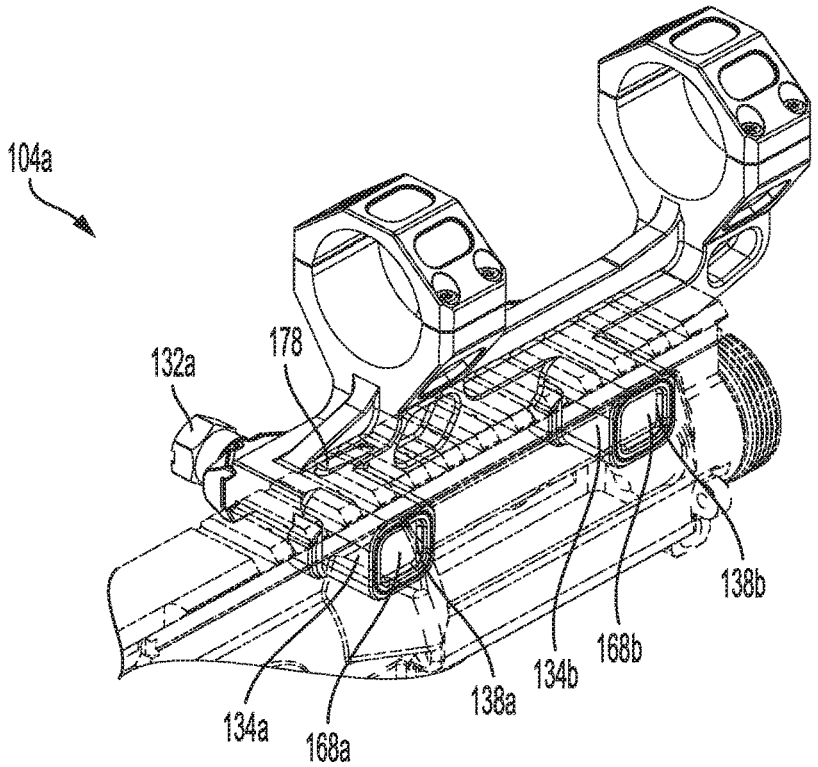
FIG. 5A illustrates a perspective view of an indicator of the example accessory mount in the tightened position.
Figure 5B:
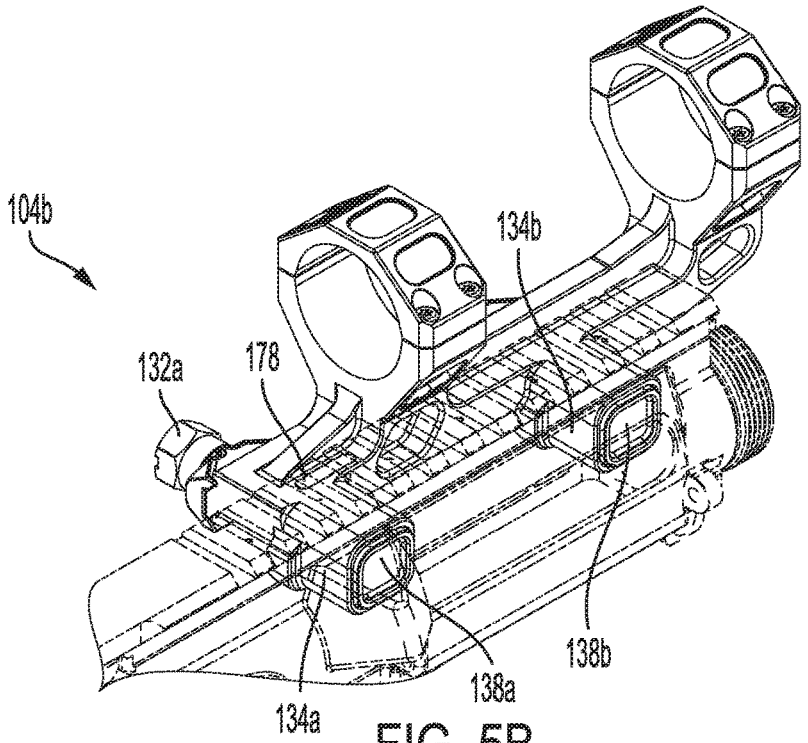
FIG. 5B illustrates a perspective view of an indicator of the example accessory mount in the loosened position.

FIG. 5A illustrates a perspective view of an indicator 178 of the accessory mount 104 in the tightened position, according to one or more embodiments of the present disclosure. FIG. 5B illustrates a perspective view of the indicator 178 of the accessory mount 104 in the loosened position, according to one or more embodiments of the present disclosure.

As shown in FIG. 5A and FIG. 5B, in one or more embodiments, an indicator 178 is located on a top portion of the lower portion 123 of the accessory mount 104. The indicator 178 is configured to rotate on a hinge so that a portion of the indicator 178 can move in an upward direction and a downward direction. In one or more embodiments, when the biased cross-bolt assembly 136*a* is mounted in a tightened position, the inner surface of the bolt head 168*a* presses against a receiving structure (e.g., a pin, not shown) that is suspended in the housing 134*a*. As the bolt head 168*a* presses against the receiving structure, the receiving structure in turn presses against a portion of the indicator 178, thereby rotating the indicator 178 in an upward direction. By moving the indicator 178 in an upward direction, the indicator 178 provides a visual indication confirming that the fastener 132*a* is properly tightened on the bolt 138*a*. When the indicator 178 is positioned in a maximum upper position, the indicator 178 does not move upwards any further, which indicates that the bolt assembly clamps 130*a* and 131*a* have attained the proper attachment (clamping) force. In one or more embodiments, when the biased cross-bolt assembly 136*a* is being configured into a loosened position, the bolt head 168*a* moves out of the housing 134*a*. As the bolt head 168*a* moves in an outward direction, the receiving structure also moves in the same direction as the bolt head 168*a*, thereby rotating the indicator 178 in a downward direction. By moving the indicator 178 in a downward direction, the indicator 178 indicates that the fastener 132*a* is being loosened on the bolt 138*a*. When the indicator 178 is positioned in a maximum lower position, the indicator 178 does not move downwards any further, which indicates that the accessory mount 104 is in a loosened position and may be removed from the mounting platform 106 of the firearm.

In other embodiments, the position of the indicator 178 indicates a level of axial attachment force. For example, when the indicator 178 is positioned in the maximum lower position, the indicator 178 indicates an axial attachment force of 0 lbs. In another example, based on the design of the biasing assembly 174*a*, when the indicator 178 is positioned in the maximum upper position, the indicator 178 indicates an axial attachment force of about lbs. In another example, based on the design of the biasing assembly 174*a*, when the indicator 178 is positioned in the maximum upper position, the indicator 178 indicates an axial attachment force of about 1000 lbs. In yet another example, when the indicator 178 is in a position in a middle of the maximum upper position and the maximum lower position, the indicator 178 indicates an axial attachment force of about 375 lbs or about 500 lbs, based on the design of the biasing assembly 174*a*.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An accessory mount for attaching an accessory to a firearm comprising:

at least one cross-bolt assembly configured to attach the accessory mount to the firearm, wherein the at least one cross-bolt assembly extends perpendicular to a longitudinal direction of the accessory mount and comprises:

a housing;

a biasing assembly configured to fit within the housing and to provide an axial attachment force; and an extension feature configured to be inserted through the biasing assembly and the housing and to be fastened to the accessory mount;

wherein the housing includes a stop shelf formed on one or more inner surfaces of the housing, and the stop shelf is configured to contact a head of the extension feature.

2. The accessory mount of claim 1, wherein an opening of the housing is configured to receive a head of the extension feature, and wherein the head of the extension feature is configured to prevent the extension feature from rotating in a circumferential direction as the extension feature is fastened to the accessory mount.

3. The accessory mount of claim 2, wherein the head of the extension feature is configured to fit within the opening of the housing.

4. The accessory mount of claim 1, wherein the biasing assembly is further configured to provide an axial attachment force of about 750 pounds to about 1000 pounds.

5. The accessory mount of claim 1, wherein the stop shelf is configured to prevent a head of the extension feature from moving inwardly beyond a portion of the housing.

6. The accessory mount of claim 1, wherein the biasing assembly includes at least one Belleville washer.

7. The accessory mount of claim 6, wherein the biasing assembly includes at least one flat washer and a plurality of Belleville washers.

8. The accessory mount of claim 1, wherein the extension feature includes a groove locator configured to fit between two consecutive ribs of a mounting platform of the firearm.

9. The accessory mount of claim 1, wherein the extension feature is fastened to the accessory mount by a fastener, and wherein the extension feature is configured to prevent the fastener from detaching from the extension feature.

10. The accessory mount of claim 1, further including at least one mounting cap removably securable to an upper portion of the accessory mount, the at least one mounting cap configured to form a passage extending in a longitudinal direction of the accessory mount.

11. The accessory mount of claim 1, further including an indicator rotatably connected to the accessory mount, wherein the indicator is configured to indicate a predetermined attachment force when rotated to an upper position.

12. The accessory mount of claim 1, wherein the extension feature is a bolt.

13. The accessory mount of claim 1, wherein, when the head of the extension feature contacts the stop shelf, the biasing assembly is configured to compress to a predetermined axial attachment force.

14. The accessory mount of claim 1, wherein an inner surface of the head is configured to contact the stop shelf.

15. The accessory mount of claim 1, wherein the biasing assembly provides a predetermined axial attachment force when an outer surface of the head aligns with an outer surface of the housing.

16. A firearm comprising the accessory mount of claim 1.

17. A method of attaching an accessory mount to a firearm with a predetermined attachment force, comprising the steps of:

obtaining an accessory mount comprising at least one cross-bolt assembly configured to attach the accessory mount to the firearm, wherein the at least one cross-bolt assembly extends perpendicular to a longitudinal direction of the accessory mount and comprises:

a housing having a first attachment feature, wherein the housing includes a stop shelf formed on one or more inner surfaces of the housing, a biasing assembly configured to fit within the housing and to provide the predetermined attachment force, and an extension feature configured to be inserted through the biasing assembly, the housing, and a second attachment feature positioned on a side of the accessory mount opposite the first attachment feature, and to be fastened to the accessory mount by a fastener;

positioning the accessory mount on a rail of the firearm; and tightening the fastener onto the extension feature until the extension feature contacts the stop shelf, thereby fastening the accessory mount to the firearm via the first and second attachment features, wherein the accessory mount is attached to the firearm with the predetermined attachment force without using a torque wrench.

18. The method of claim 17, wherein when the extension feature contacts the stop shelf, the accessory mount is fastened to the firearm with a predetermined attachment force of about 750 pounds to about 1000 pounds.

19. The method of claim 17, wherein an opening of the housing is configured to receive a head of the extension feature, and wherein the head of the extension feature is configured to prevent the extension feature from rotating in a circumferential direction as the extension feature is fastened to the accessory mount.

20. The method of claim 17, wherein the biasing assembly includes at least one flat washer and a plurality of Belleville washers.

21. The method of claim 17, wherein the accessory mount further comprises an indicator rotatably connected to the accessory mount, and wherein tightening the fastener on the extension feature rotates the indicator in an upward direction, and thereby indicates an increasing amount of attachment force.

22. The method of claim 17, wherein the extension feature is a bolt.

* * * * *